US010051907B2

(12) United States Patent
Dammann et al.

(10) Patent No.: US 10,051,907 B2
(45) Date of Patent: Aug. 21, 2018

(54) WATER-RESISTANT HEADWEAR

(71) Applicants: Myrene Anderson Dammann, Longmont, CO (US); Cinda Lou Kochen, Boulder, CO (US); Tami Jean Kochen, Boulder, CO (US)

(72) Inventors: Myrene Anderson Dammann, Longmont, CO (US); Cinda Lou Kochen, Boulder, CO (US); Tami Jean Kochen, Boulder, CO (US)

(73) Assignee: The Shower Scene LLC, Boulder, CO (US)

( * ) Notice: Subject to any disclaimer, the term of this patent is extended or adjusted under 35 U.S.C. 154(b) by 682 days.

(21) Appl. No.: 13/652,977

(22) Filed: Oct. 16, 2012

(65) Prior Publication Data

US 2014/0101821 A1 Apr. 17, 2014

(51) Int. Cl.
*A42B 1/12* (2006.01)
*A42B 1/22* (2006.01)

(52) U.S. Cl.
CPC . *A42B 1/12* (2013.01); *A42B 1/22* (2013.01)

(58) Field of Classification Search
CPC ..... A42B 1/041; A42B 1/22; A42B 1/006; A42B 1/064; A42B 1/206; A42B 1/225; A42B 1/248; A42B 3/00; A42B 3/121; A42B 3/18; A42B 3/24; A42B 3/283; A42B 3/285; A42B 7/00; A42B 1/004; A42B 1/04; A42B 1/045; A42C 5/02; A45D 44/12
USPC ..... 132/57.1, 270, 274, 273; 2/171, 11, 183, 2/174, 171.4, 202, 423
See application file for complete search history.

(56) References Cited

U.S. PATENT DOCUMENTS 40,118 A * 9/1863 Perkins ..... 2/207
809,947 A * 1/1906 Herndon ..... A42B 1/12 2/181
946,770 A * 1/1910 Sands ..... 2/68
1,081,333 A * 12/1913 Reese ..... A42B 1/066 2/172
1,211,075 A * 1/1917 Burns ..... A42B 1/22 2/181
1,269,594 A * 6/1918 Geraghty ..... 2/209.11
1,393,652 A * 10/1921 Van Huele ..... 2/181
1,511,129 A * 10/1924 McKnight ..... 2/181
1,521,149 A * 12/1924 Clarizio ..... 132/274
1,563,693 A * 12/1925 Drucks ..... 132/274
(Continued)

*Primary Examiner* — Alissa L Hoey
*Assistant Examiner* — Catherine M Ferreira
(74) *Attorney, Agent, or Firm* — Duft Bornsen & Fettig, LLP

(57) ABSTRACT

Headwear apparel comprising a draw cord and a locking means. The draw cord slides through a channel that defines an opening in the bottom portion of the apparel. The draw cord may be positioned by the user to cinch the channel to adjust tension of the opening to conform to the user's head. The locking means engages the draw cord to hold the position of the draw cord relative to the channel and thus retain the desired tension of the channel around the user's head. The headwear may comprise water-repellant material to repel water from the user's head for use in inclement weather or in personal bathing. In some embodiments, an inner liner material may be included for added comfort of the user. In some embodiments, a stylized hat structure may be added to the top of the headwear.

20 Claims, 6 Drawing Sheets

(56) References Cited

U.S. PATENT DOCUMENTS

| | | | | | |
|---|---|---|---|---|---|
| RE17,064 | E | * | 8/1928 | Fischer | 2/183 |
| 1,725,425 | A | * | 8/1929 | Steingold | 2/181 |
| 1,992,285 | A | * | 2/1935 | Blum | 2/183 |
| 2,128,358 | A | * | 8/1938 | Glick | 132/274 |
| 2,183,963 | A | * | 12/1939 | Henry | 132/274 |
| 2,194,043 | A | * | 3/1940 | Jacobi | 2/183 |
| 2,261,811 | A | * | 11/1941 | Saigh | 132/274 |
| 2,356,042 | A | * | 8/1944 | Ferber | 2/183 |
| 2,368,972 | A | * | 2/1945 | Despres | 132/274 |
| 2,414,665 | A | * | 1/1947 | Podolsky | 2/183 |
| 2,475,320 | A | * | 7/1949 | Herschensohn | 132/274 |
| 2,583,992 | A | * | 1/1952 | Bouteloup | 2/237 |
| 2,696,007 | A | * | 12/1954 | Larkin | A42B 1/08 2/171 |
| 2,739,602 | A | * | 3/1956 | Herschensohn | 132/274 |
| 2,775,973 | A | * | 1/1957 | McDonough | 132/274 |
| 2,869,137 | A | * | 1/1959 | Scherz | 2/195.4 |
| 3,200,827 | A | * | 8/1965 | Hill | 132/274 |
| 3,206,761 | A | * | 9/1965 | Melnikoff | 2/68 |
| D205,829 | S | * | 9/1966 | Gettinger | D2/880 |
| 3,392,737 | A | * | 7/1968 | Fefferman | 132/274 |
| 3,522,813 | A | * | 8/1970 | Corey | 132/274 |
| 3,556,115 | A | * | 1/1971 | Benson | 132/274 |
| 3,714,670 | A | * | 2/1973 | Pollack et al. | 2/183 |
| 3,750,681 | A | * | 8/1973 | Claunch | 132/274 |
| 4,289,150 | A | * | 9/1981 | Kimball | 132/270 |
| 4,459,471 | A | * | 7/1984 | Hulett et al. | 219/527 |
| 4,468,815 | A | * | 9/1984 | Pellegri | 2/171.01 |
| 5,203,358 | A | * | 4/1993 | Eytcheson | 132/212 |
| 5,309,574 | A | * | 5/1994 | Balaban et al. | 2/202 |
| 5,351,343 | A | * | 10/1994 | Harbison | 2/423 |
| 5,450,629 | A | * | 9/1995 | Gilstrap | 2/209.11 |
| 5,548,845 | A | * | 8/1996 | Gallup | 2/195.2 |
| 5,579,540 | A | * | 12/1996 | Walker | 2/209.11 |
| 5,664,261 | A | * | 9/1997 | Lacy | 2/172 |
| 5,694,647 | A | * | 12/1997 | Crickmore | 2/172 |
| 5,920,909 | A | * | 7/1999 | Ellsworth et al. | 2/171 |
| 6,041,439 | A | * | 3/2000 | Yamanaka | 2/183 |
| 6,345,395 | B1 | * | 2/2002 | Chilton | 2/183 |
| 6,467,096 | B1 | * | 10/2002 | Coluccio | 2/195.2 |
| 6,572,601 | B2 | * | 6/2003 | Suprise et al. | 604/391 |
| D501,067 | S | * | 1/2005 | Schenck et al. | D2/880 |
| 7,665,154 | B2 | * | 2/2010 | Gerstel Costello | 2/195.2 |
| 7,707,657 | B2 | * | 5/2010 | Kim | 2/209.12 |
| 7,930,768 | B1 | * | 4/2011 | Tyler | 2/209.11 |
| 8,375,469 | B2 | * | 2/2013 | Duwyn-Zylstra | 2/175.1 |
| 8,402,564 | B2 | * | 3/2013 | Duwyn-Zylstra | 2/175.1 |
| 2003/0029470 | A1 | * | 2/2003 | Srivastava | 132/274 |
| 2004/0094179 | A1 | * | 5/2004 | Baldwin | 132/274 |
| 2005/0247327 | A1 | * | 11/2005 | Ison | 132/274 |
| 2006/0168709 | A1 | * | 8/2006 | Rattay | 2/183 |
| 2009/0151055 | A1 | * | 6/2009 | Duncan | 2/410 |
| 2010/0108088 | A1 | * | 5/2010 | Britton et al. | 132/200 |
| 2010/0192282 | A1 | * | 8/2010 | Matthews | 2/174 |
| 2012/0030858 | A1 | * | 2/2012 | Duffin | 2/183 |

* cited by examiner

WATER-RESISTANT HEADWEAR

BACKGROUND

1. Field of the Invention

The invention relates generally to headwear apparel and more specifically relates to a water-resistant headwear that provides improved comfort, improved secure fit, and improved lifetime.

2. Discussion of Related Art

Water-resistant headwear is used for protection from weather elements and in bathing to keep a person's hair dry—protected from water and moisture. Presently designed water-resistant headwear (e.g., present shower caps) are often designed as disposable elements having a short life-cycle. For example, many shower caps use an elastic band around the base of the cap to retain the cap on the user's head. This elastic band tends to wear out quickly such that the cap no longer is well secured to the user's head thus diminishing the essential purpose of the apparel—protection from water and moisture. Further, present water-resistant headwear offer limited or no choices for style to be utilized in public outside the context of personal bathing (e.g., such as inclement weather protection). Still further, some users have allergic skin reactions to certain water-resistant materials used in some headwear.

Thus it is an ongoing challenge to provide improved water-resistant headwear designs.

SUMMARY

The present invention solves the above and other problems, thereby advancing the state of the useful arts, by providing headwear apparel that is water repellant (i.e., for bathing and/or inclement weather). The headwear comprises a draw cord and locking means at its bottom portion to allow for simple adjustment of tensioning the headwear around the user's head.

In one aspect hereof, headwear apparel is provided comprising a material forming a cavity to receive a human head through an opening at a bottom portion and a channel substantially defining the opening and proximate to the bottom portion of the apparel. The apparel further comprises a draw cord positioned to slide within the channel. The draw cord has a portion that exits the channel to provide access to the draw cord for a user of the apparel. The apparel further comprises a locking means associated with the portion of the draw cord that exits the channel. The locking means is configured to hold the draw cord at a desired position. The user can move the portion of the draw cord that exits the channel to the desired position to cinch the channel, thereby providing tension on the bottom portion of the apparel to substantially conform the opening to the user's head. The user can configure the locking means to hold the draw cord at the desired position.

DETAILED DESCRIPTION OF THE DRAWINGS

Figure 1A:
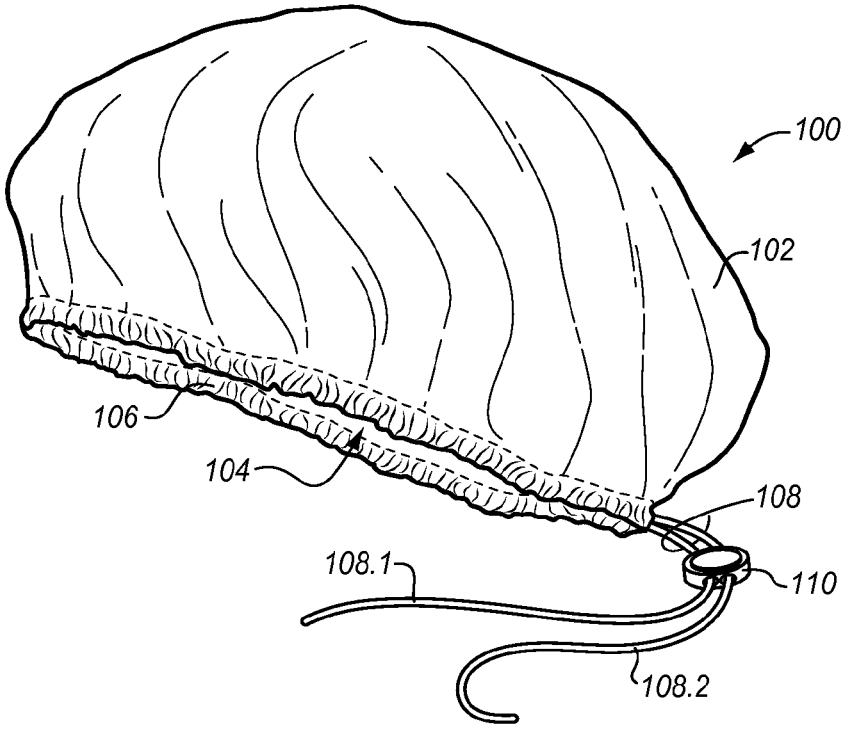
FIGS. 1A through 1C depict exemplary embodiments of headwear apparel as a shower cap including various configurations of the draw cord in accordance with features and aspects hereof.

FIG. 1A is a diagram of an exemplary embodiment of improved headwear apparel (e.g., a shower cap) in accordance with features and aspects hereof. Shower cap (apparel) 100 comprises material 102 configured to form a cavity to receive a human head through an opening 104. Channel 106 substantially defines opening 104. Draw cord 108 is positioned to slide within channel 106. Portions 108.1 and 108.2 exit channel 106 to provide access to the draw cord by the user of the apparel. The user may expand opening 104 (drawing draw cord 108 into channel 106) to permit the user's head to fit into cavity 104 through opening 106. Once positioned on the user's head, the user may move (i.e., pull) draw cord portions 108.1 and/or 108.2 to cinch channel 106 to thereby tension opening 104 to substantially conform to the users head and to substantially seal the user's head from moisture. Once the user has drawn on draw cord 108 (by pulling on one or both cord portions 108.1 and/or 108.2), the user may engage locking means 110 with draw cord 108. Locking means 110 is configured to hold the draw cord at a desired position (providing the desired tension to cinch channel 106 and thereby opening 104 to conform to the user's head).

In one exemplary embodiment, material 102 comprises a water repellent material/fabric such as polyurethane or polyurethane laminate (the latter sometimes referred to as "PUL"). In some embodiments, draw cord 108 may be an inelastic cord such as a nylon cord while in other embodiments, for additional comfort and flexibility, draw cord 108 may be an elastic cord such as a nylon bungee cord (sometimes referred to as "shock cord" or "stretch cord"). A #24 size 3/32" bungee cord has proven useful but any suitable size may be employed. Locking means 110 may comprise any suitable structure for engaging draw cord 108 to hold or lock the position of draw cord relative to the channel 106 in which draw cord 108 is configured to slide. In one exemplary embodiment locking means 110 may be a cord lock as generally known in the industry that provides a spring tension to grip draw cord 108 at any desired position. In one exemplary embodiment, a 3/4" drum style cord lock may be employed but any suitable size or style of cord lock may be employed as appropriate to slide on and grip the draw cord. A cord lock (locking means 110) may be slid along draw cord 108 to a desired position providing the appropriate tension for channel 106 and thus opening 104.

Figure 1B:
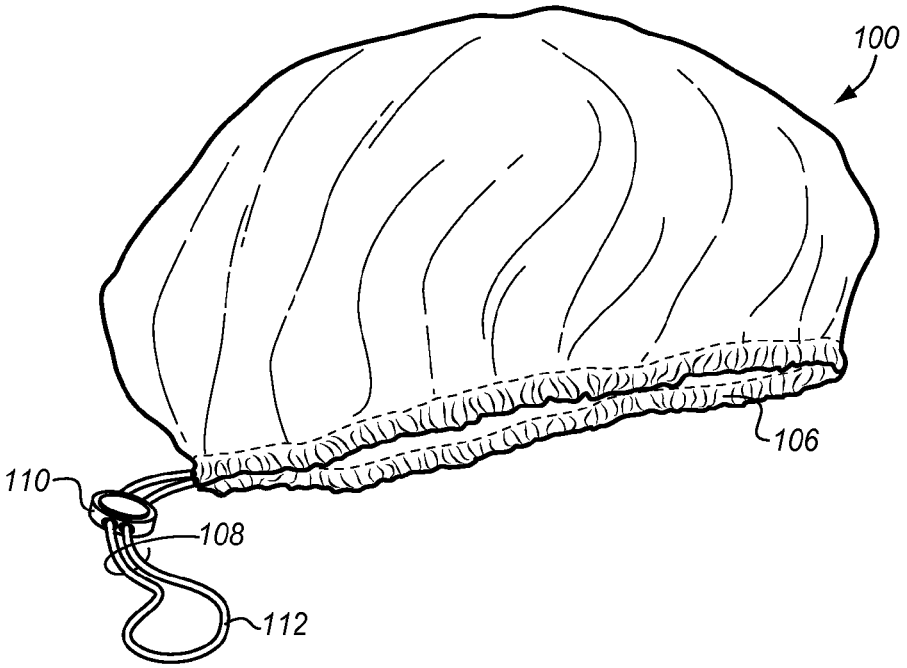
Figure 1C:
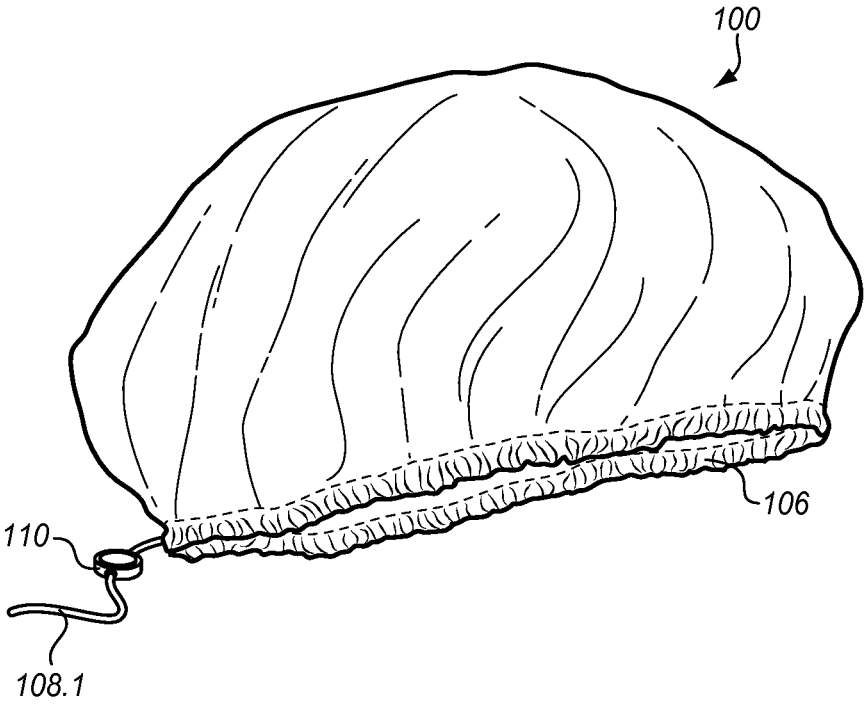

FIG. 1B shows a variant of the shower cap 100 of FIG. 1A wherein draw cord 108 forms a continuous loop such that the cord exits the channel 106 with loop end 112. Locking means 110 (e.g., a cord lock) may then be positioned on draw cord 108 such that loop end 112 prevents locking means 110 from falling off cord draw cord 108 and prevents draw cord 108 from escaping from channel 106. FIG. 1C shows yet another exemplary embodiment of shower cap 100 wherein a first end (not shown) of draw cord 108 is fixed (attached) within channel 106 such that only other end 108.1 of draw cord 108 exits channel 106 and engages with locking means 110.

Figure 2A:
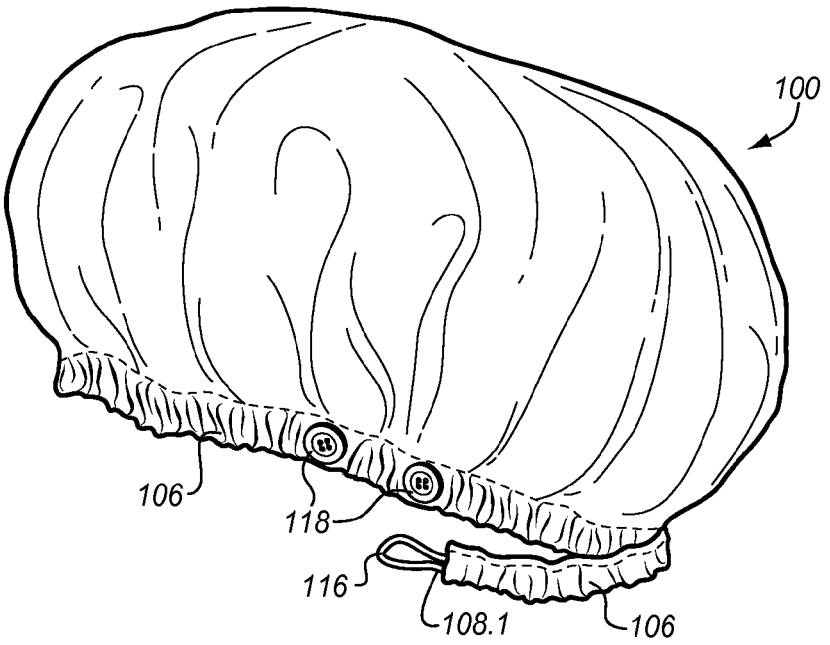
FIGS. 2A and 2B depict alternate embodiments of the locking means to hold the position of the draw cord in accordance with features and aspects hereof.
Figure 2B:
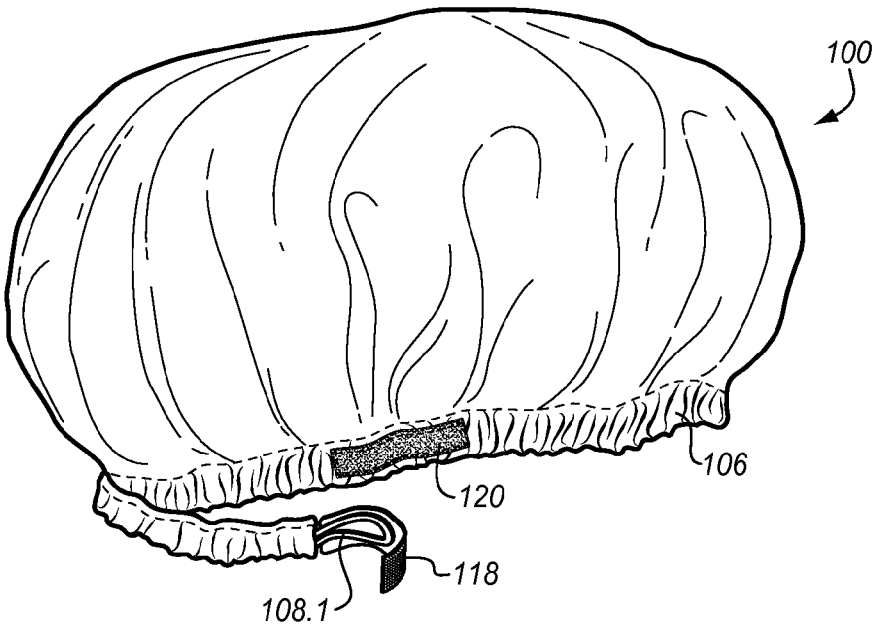

FIG. 2A shows another exemplary embodiment of shower cap 100 wherein a first end (not shown) of draw cord 108 is fixed (attached) within channel 106 and other end 108.1 exits channel 106. In this exemplary embodiment, the locking means comprises a loop end 116 of draw cord other end 108.1 that engages with one or more buttons 118 affixed to the bottom portion of the headwear around channel 106. In operation, a user pulls loop end 116 of draw cord other end 108.1 to a position to provide desired tension (by cinching channel 106 around the user's head) and attaches loop end 116 to a nearby button 118 to hold or lock the draw cord at the desired position. FIG. 2B depicts yet another exemplary embodiment of shower cap 100 wherein the locking means comprises a hook-and-loop fastener (e.g., Velcro). Such a hook-and-loop fastener typically comprises a hook portion 120 that receives a loop portion 118. In the exemplary embodiment of FIG. 2B the hook portion 120 may be affixed to the bottom portion of shower cap 100 along channel 106 and loop portion 118 may be affixed to other end 108.1 of draw cord that exits channel 106.

Figure 3:
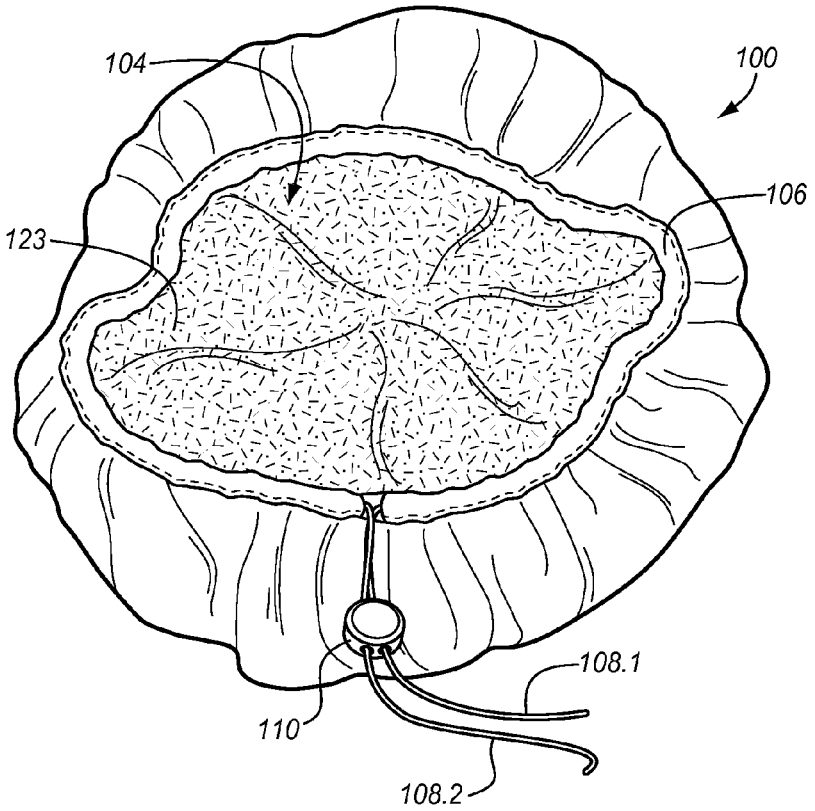
FIG. 3 is a bottom view of an alternate exemplary embodiment of the headwear providing an inner lining material for added comfort in accordance with features and aspects hereof.

FIG. 3 presents a bottom view of shower cap 100 of FIG. 1A exhibiting an exemplary embodiment in which the inside surface of the cap (forming the cavity to receive the head) is lined with a second material 123. The water repellent material that forms the outer portion of shower cap 100 may be uncomfortable for some users and, depending on the selection of material, may cause allergic reactions in some users. The exemplary embodiment of FIG. 3 provides for an inner liner material to avoid such problems. For example, the inner liner material may be a cotton material or other common material that rarely presents such discomforts to a human. In one exemplary embodiment, a 100% cotton, 4 oz. wt. poplin material may be employed but any suitable liner material may be similarly utilized.

Figure 4:
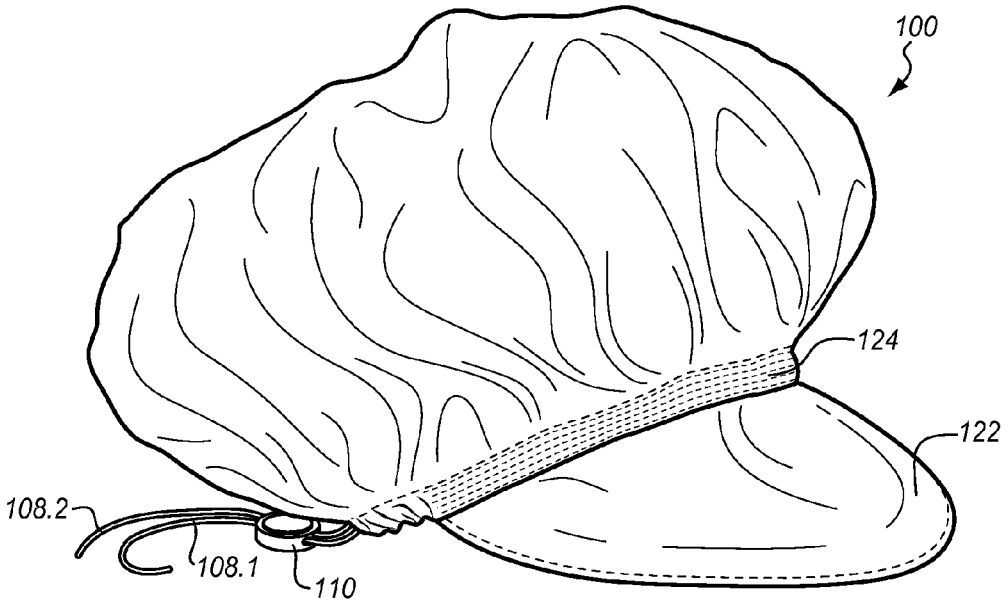
FIGS. 4 through 6 depict an alternate embodiment of headwear apparel having a brim attached to the front of the headwear.
Figure 5:
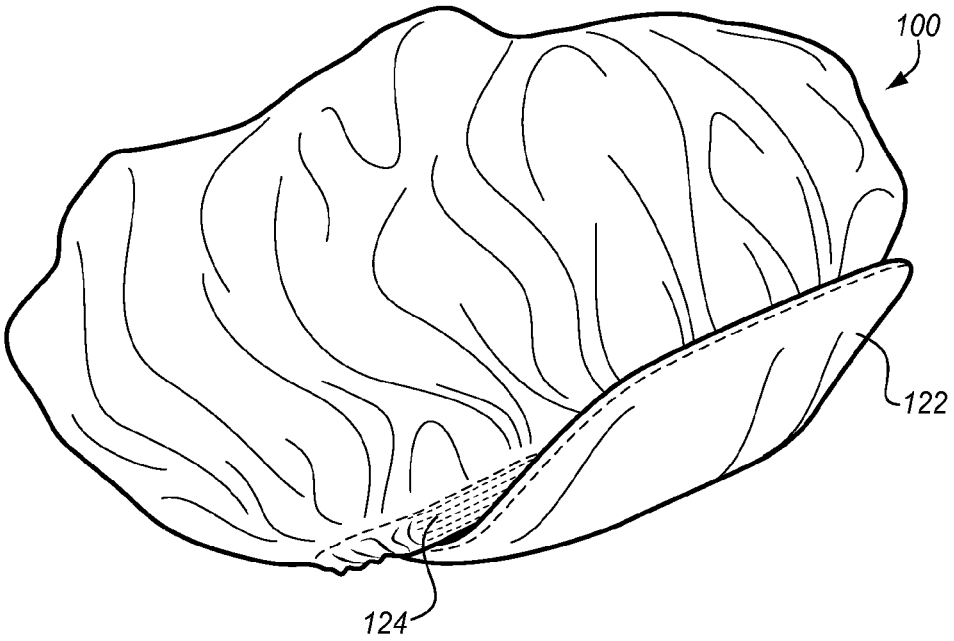
Figure 6:
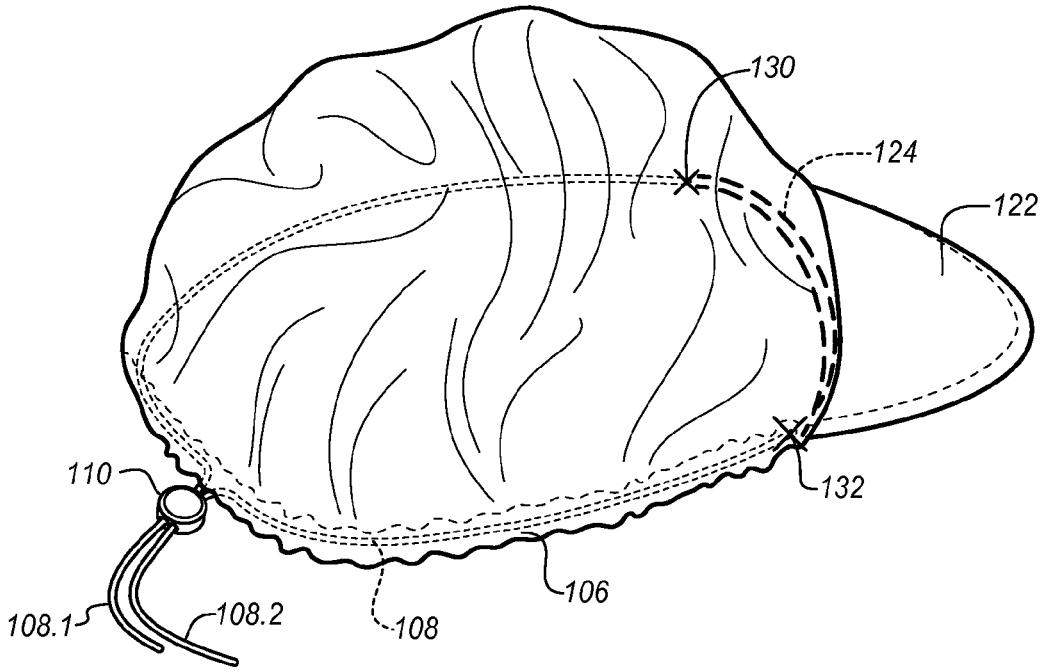

FIG. 4 depicts another exemplary embodiment of shower cap 100 wherein the shower cap is configured with brim 122 coupled to the bottom portion of shower cap 100 by joint 124. Joint 124 may comprise a more rigid material such that joint 124 will not compress or cinch when a user pulls on draw cord 108.1 or 108.2 to cinch the channel and opening of the shower cap. Further, joint 124 may present an arcuate form following generally the shape of the human forehead such that brim 122 may be flipped up and retained in the up position as shown in FIG. 5. Such a brim may be useful, for example in the context of a shower cap, to allow the user easier access to washing of the face without the brim interfering as may be the case with the brim in the lower position of FIG. 4. While in the lower position, brim 122 helps to drain moisture water away from the user's face. FIG. 6 depicts joint 124 viewed through a cutaway of shower cap 100 depicting two endpoints of the more rigid joint material (endpoints 130 and 132). Draw cord 108 may be affixed to endpoint 130 and 132 such that drawing on draw cord 108 will not substantially alter or deflect the desired shape of brim 122 at joint 124.

Figure 7:
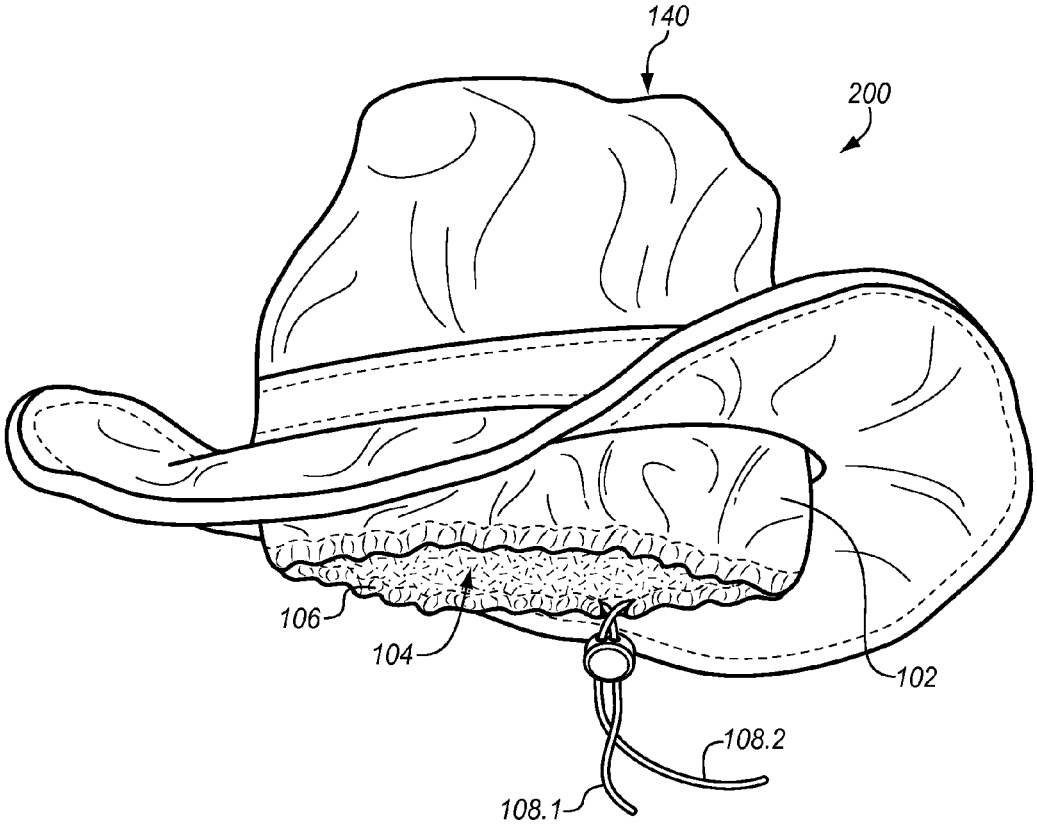
FIG. 7 depicts an alternate embodiment of headwear apparel further comprising a stylized element for public use in inclement weather.

FIG. 7 shows an exemplary embodiment of headwear apparel 200 in which water resistant material 102 is used to form a water repellant structure as described above with respect to FIGS. 1 through 3 but further incorporates a stylized element 140 affixed to the outer surface of material 102. Such a stylized element 140 makes the headwear apparel more suitable for public wear such as for protection from inclement weather. It will be evident that any desired style may be chosen as appropriate for the particular occasion.

While the invention has been illustrated and described in the drawings and foregoing description, such illustration and description is to be considered as exemplary and not restrictive in character. One embodiment of the invention and minor variants thereof have been shown and described. Protection is desired for all changes and modifications that come within the spirit of the invention. Those skilled in the art will appreciate variations of the above-described embodiments that fall within the scope of the invention. As a result, the invention is not limited to the specific examples and illustrations discussed above, but only by the following claims and their equivalents.

What is claimed is:

1. Headwear apparel comprising:

a material forming a cavity adapted to receive a human head through an opening at a bottom portion;

a brim coupled to a bottom portion of the cavity and extending outward from the cavity;

a channel defining the opening and extending along a portion of the circumference of the bottom portion of the apparel, wherein the channel defines a lower edge of the bottom portion;

a draw cord positioned to slide within the channel, the draw cord having a portion that exits the channel to provide access to the draw cord for a user of the apparel; and a locking means associated with the portion of the draw cord that exits the channel, the locking means configured to hold the draw cord at a desired position, wherein the portion of the draw cord that exits the channel is movable to the desired position to cinch the channel, thereby providing tension on the bottom portion of the apparel configured to conform the opening to the user's head and seal the user's hair from external moisture, wherein the locking means is configured by holding the draw cord at the desired position, and wherein the brim is attached to an arcuate joint section comprising a rigid material on the cavity that resists deformation when the draw cord is held taught.

2. The apparel of claim 1 wherein the material is polyurethane laminate.

3. The apparel of claim 1 wherein the draw cord forms a continuous loop.

4. The apparel of claim 1 wherein the material is water repellant, wherein the apparel further comprises a non-water repellant liner material lining the cavity of the apparel enhancing comfort of the user.

5. The apparel of claim 1 wherein the locking means comprises a cord lock slideably engaging the portion of the draw cord that exits the channel.

6. The apparel of claim 5 wherein the draw cord has two ends including one end fixedly attached to the material.

7. The apparel of claim 1 wherein the locking means further comprises:

a closed loop configured in the portion of the draw cord that exits the channel; and a button fixedly attached to an exterior surface of the apparel configured to receive the closed loop.

8. The apparel of claim 7 wherein the draw cord comprises an elastic material such that the draw cord is configured to be stretched to engage the loop with the button to provide the tension of the bottom portion around the user's head.

9. The apparel of claim 1 wherein the locking means further comprises:

a closed loop configured in the portion of the draw cord that exits the channel; and a plurality of buttons fixedly attached to an exterior surface of the apparel at a plurality of positions around the opening at the bottom portion of the apparel, each button configured to receive the closed loop, wherein each of the plurality of buttons corresponds with a different tension of the bottom portion around the user's head.

10. The apparel of claim 1 wherein the locking means further comprises:

a hook material attached the portion of the draw cord that exits the channel; and a loop material fixedly attached to an exterior surface of the apparel at a plurality of positions around the opening at the bottom portion of the apparel, whereby the tension of the bottom portion around the user's head is adjustable by engaging the hook material on a position of the loop material.

11. The apparel of claim 1 wherein the draw cord comprises two ends that both exit the channel each through the same opening of the channel, wherein the locking means is attached to one end of the draw cord and movably attached to the other end of the draw cord such that the position of the locking means with respect to the other end of the draw cord is adjustable to alter the tension of the bottom portion around the user's head.

12. The apparel of claim 1 wherein the draw cord comprises two ends that both exit the channel each through the same opening of the channel, wherein the locking means is movably attached to both ends of the draw cord such that the position of the locking means with respect to the both ends of the draw cord is adjustable to alter the tension of the bottom portion around the user's head.

13. The apparel of claim 1 wherein the draw cord comprises a loop that exits the channel, wherein the locking means is movably attached to the loop such that the position of the locking means with respect to the loop is adjustable to alter the tension of the bottom portion around the user's head.

14. The apparel of claim 1 further comprising:

a circumferential band surrounding the cavity and attached to the headwear above the brim.

15. The headwear apparel of claim 1, wherein:

the channel includes a portion that extends beyond the cavity, and an end of the channel that is distal from the cavity is proximate to the locking means.

16. The headwear apparel of claim 1, wherein:

the bottom portion that extends beneath the brim is adapted to conform with a user's head beneath the brim.

17. Shower cap headwear apparel comprising:

a water repellant polyurethane laminate material forming a cavity adapted to receive a human head through an opening at a bottom portion;

a brim encircling the cavity and extending outward from the cavity, wherein the brim includes a stitched pattern proximate to an outer edge of the brim;

a channel, formed by stitching the material, defining the opening and extending along the entire circumference of the bottom portion of the apparel, wherein the channel defines a lower edge of the bottom portion, and the bottom portion extends the cavity beneath the brim and is adapted to cover hair that extends beneath the brim, wherein the channel includes a length that extends outside of the cavity, as well as a length that defines the cavity, an elastic nylon draw cord positioned to slide within the channel, the draw cord having a portion that exits the channel to provide access to the draw cord for a user of the apparel, wherein the portion of the draw cord that exits the channel is movable to the desired position to cinch the channel, thereby providing tension on the bottom portion of the apparel configured to conform the opening to the user's head and seal the user's hair from external moisture, and a loop of the draw cord extending from the length of the channel that extends outside of the cavity, the loop configured to hold the draw cord at a desired position, wherein the loop is configured by holding the draw cord at the desired position and attaching the loop to any of multiple buttons stitched to the length of the channel that defines the cavity, wherein the apparel further comprises a cotton poplin non-water repellant liner material that lines an entirety of the cavity of the apparel and is adapted to enhance comfort of the user, and wherein the brim is attached to an arcuate joint section of the apparel comprising a rigid material on the cavity that resists deformation when the draw cord is held taught.

18. Shower cap headwear apparel comprising:

a material forming a cavity adapted to receive a human head through an opening at a bottom portion;

a brim coupled to a bottom portion of the cavity and extending outward from the cavity;

a channel defining a portion of the opening and extending along a first portion of the circumference of the bottom portion of the apparel, wherein the channel defines a lower edge of the bottom portion;

a draw cord positioned to slide within the channel, the draw cord having a portion that exits the channel to provide access to the draw cord for a user of the apparel; and a locking means associated with the portion of the draw cord that exits the channel, the locking means configured to hold the draw cord at a desired position, wherein the brim is attached to an arcuate joint, comprising a rigid material on a second portion of the circumference of the bottom portion of the apparel, that resists compression when the draw cord is drawn, wherein the arcuate joint is adapted to retain an orientation of the brim while the brim is flipped up, and to retain an orientation of the brim while the brim is flipped down, wherein the draw cord is fixedly attached to the arcuate joint proximate to endpoints of the arcuate joint, and wherein the portion of the draw cord that exits the channel is movable to the desired position to cinch the channel, thereby providing tension on the bottom portion of the apparel configured to conform the opening to the user's head and seal the user's hair from external moisture, by pressing the bottom portion of the apparel and the brim against the user, wherein the locking means is configured by holding the draw cord at the desired position.

19. The apparel of claim 18, wherein:

the first portion of the circumference and the second portion of the circumference in combination cover the entire circumference of the bottom portion of the apparel.

20. The apparel of claim 18 wherein the material is water repellant, wherein the apparel further comprises a non-water repellant liner material lining the cavity of the apparel enhancing comfort of the user.

* * * * *